US005987793A

United States Patent [19]

Ebine

[11] Patent Number: 5,987,793

[45] Date of Patent: Nov. 23, 1999

[54] ILLUMINATIVE DISPLAY DEVICE AND ELECTRONIC APPARATUS EQUIPPED WITH SAME

[75] Inventor: Nobuhito Ebine, Kanagawa, Japan

[73] Assignee: Sony Corporation, Tokyo, Japan

[21] Appl. No.: 09/008,262

[22] Filed: Jan. 16, 1998

[30] Foreign Application Priority Data

Jan. 24, 1997 [JP] Japan ..... 9-011470

[51] Int. Cl.[6] ..... G09F 13/06

[52] U.S. Cl. ..... 40/580; 40/541; 362/29

[58] Field of Search ..... 40/580, 570, 541, 40/579, 219; 340/332; 362/23, 29, 109

[56] References Cited

U.S. PATENT DOCUMENTS

| | | | |
|---|---|---|---|
| 3,676,943 | 7/1972 | Kidd, Jr. et al. . | |
| 3,861,995 | 1/1975 | Kellogg, Jr. . | |
| 4,170,663 | 10/1979 | Hahn et al. . | |
| 4,240,220 | 12/1980 | Smith | 40/564 |
| 4,466,208 | 8/1984 | Logan, Jr. et al. | 40/580 X |
| 4,967,317 | 10/1990 | Plumly | 40/570 X |
| 4,977,695 | 12/1990 | Armbruster | 40/541 |
| 5,210,967 | 5/1993 | Brown | 40/219 |
| 5,214,870 | 6/1993 | Cohen | 40/580 X |
| 5,237,766 | 8/1993 | Mikolay | 40/580 X |
| 5,249,104 | 9/1993 | Mizobe . | |
| 5,299,109 | 3/1994 | Grondal | 40/570 X |
| 5,544,019 | 8/1996 | Tatavoosian et al. | 362/23 |
| 5,544,020 | 8/1996 | Loeber et al. | 362/29 |
| 5,657,004 | 8/1997 | Whittaker et al. . | |

OTHER PUBLICATIONS

Patent Abstracts Of Japan, vol. 16, No. 532 (P–1448), Oct. 30, 1992, JP 4–198977 A (Yutaka Takagaki).

*Primary Examiner*—Joanne Silbermann
*Attorney, Agent, or Firm*—Frommer Lawrence & Haug, LLP.; William S. Frommer

[57] ABSTRACT

An illuminative display device for use in an electronic apparatus including a cabinet with a metallic color surface and having at least a main function and a subsidiary function. The display device comprises a light source and a transparent sheet spaced apart therefrom by a predetermined distance, wherein a colored layer composed of a thin film and being the same or substantially the same in color as the metallic color of the cabinet is formed on one side of the transparent sheet opposed to the light source, and a backing layer with cutout characters is formed on one side of the colored layer opposed to the light source, so as to display the characters relative to the subsidiary function. And other display characters relative to the main function are shown on the surface of the transparent sheet at positions not overlapping with the display characters relative to the subsidiary function. The display characters are completely invisible when the illuminating light is turned off, whereby the appearance of the display device is rendered congruous with the metallic or similar color of the surrounding cabinet.

6 Claims, 6 Drawing Sheets

ILLUMINATIVE DISPLAY DEVICE AND ELECTRONIC APPARATUS EQUIPPED WITH SAME

BACKGROUND OF THE INVENTION

1. Field of the Invention

The present invention relates to an illuminative display device for displaying names of operation keys and so forth by utilizing the illuminating light from a light source such as a light emitting diode or the like, and also to an electronic apparatus equipped with such a display device.

2. Description of the Related Art

First, an illuminative display device according to the related art and an electronic apparatus equipped with such a device will be described below with reference to FIGS. 4 to 7.

FIG. 4A is a plan view of an exemplary display device incorporated in a cabinet of a known electronic apparatus and placed in its display state, and FIG. 4B is another plan view thereof in a different state where the displayed items are partially turned off. FIG. 5A is a plan view of another exemplary display device incorporated in a cabinet of a known electronic apparatus and placed in its display state, and FIG. 5B is another plan view thereof in a different state where the displayed items are partially turned off. FIG. 6 is a partly sectional view of a ordinary illuminative display device employed in a known electronic apparatus, and FIG. 7 is a plan view illustrating the inner surface of a transparent sheet used in the illuminative display device of FIG. 6.

In FIGS. 4A and 4B, reference numeral 20 denotes a cabinet of an electronic apparatus such as a video camera equipped with a video tape recorder (hereinafter referred to simply as video camera). This video camera has both a camera shooting function as a main function and a recording/playback function as a subsidiary function. The video camera is selectively changeable to a camera shooting mode or a recording/playback mode by means of an unshown selector switch, and the selected mode is displayed on a front panel 21 of the cabinet 20 and also on a display plane 11 of an illuminative display device (hereinafter referred to simply as display device) 10 mounted on a front portion of the cabinet 20.

Items 22 to be displayed for the camera shooting function are names of operation keys 23 including start/stop mode switch, AE lock switch button, fader switch button, and backlight correction switch button. The names of these keys are denoted by characters, marks or numerals printed on the front panel 21 of the cabinet 20.

Items 12 to be displayed for the recording/playback function are names of operation keys 13 including recording, playback, stop, fast forward and rewind switches. These names are denoted by characters, marks or numerals on the display plane 11 of the display device 10 in parallel with the aforementioned items 22.

Regarding the items to be displayed in a video camera shown in FIG. 5A and 5B, operation keys 13 of the display items 12 for a recording/playback function and operation keys 23 of the display items 22 for a camera shooting function are shown in parallel on a display plane 11 of a display device 10 in the same manner as in the foregoing case. However, differing from the aforementioned display method shown in FIGS. 4A and 4B, the display items 22 for the camera shooting function are printed on the surface of the display plane 11 as will be described later, instead of being displayed on the front panel 21 of the cabinet 20.

The device 10 for displaying the names of such operation keys 13 employs a light emitting diode L for example as a light source to emit illuminating light, and has such a structure as shown in FIG. 6. More specifically, it comprises a light emitting diode L mounted on a printed-circuit board 1 and a transparent sheet 2 spaced apart by a predetermined distance from the light emitting diode L. On one side (inner surface) of the transparent sheet 2 opposed to the light emitting diode L, a black-base character-cutout backing layer 3 is formed by printing with the display items 12 which represent the names of operation keys 13 and so forth, as shown in FIG. 7, for the subsidiary or recording/playback function.

According to the display method shown in FIG. 5, display items 22 representing the names of operation keys 23 and so forth for the main or camera shooting function are printed on the surface of the transparent sheet 2 (reverse side with respect to the light emitting diode L) at positions not overlapping with the display items 12 for the recording/playback function.

The transparent sheet 2 may be composed of, for example, transparent polyethylene resin, polycarbonate resin, acrylic resin, vinyl chloride resin or the like.

In FIG. 6, reference numeral 7 denotes a lens which diffuses the illuminating light from the light emitting diode L while serving also as a switch button. When an upper portion of the lens 7 is depressed, the lens 7 is moved downward to press a switch button 8 disposed above the printed-circuit board 1 in its vicinity, thereby activating each function of the video camera.

In the display device 10 of the above-described structure, normally an unshown selector switch is set to the camera shooting function side, so that the display items 12 on the display plane 11 are turned off as shown in FIG. 4B or 5B to thereby appear as if nothing is existent. The reason for such disappearance resides in that, if the operation keys 13 for the recording/playback function are kept displayed, many keys are always seen to consequently give general users a wrong impression that operating the video camera is very complicated and difficult.

When the video camera is used as a video recording/playback apparatus, first the video camera is switched on to be energized and then an unshown selector switch is changed from the camera shooting function side to the recording/playback function side, whereby the display items 12 in off-state thereof on the display plane 11 as shown in FIG. 4B or 5B are turned on as shown in FIG. 4A or 5A, and thus the display items 12 of the operation keys 13 for the recording/playback function are displayed. In this case, the light emitting diode L is turned on when the unshown selector switch is changed to the recording/playback function side, so that the display items 12 for the recording/playback function are lit and displayed on the transparent sheet 2 through the black-base character-cutout backing layer 3 as shown in FIGS. 4A and 5A.

In this display device 10, however, cutout characters are seen even when the light emitting diode L is turned off, as shown in FIGS. 4B and 5B, and it is impossible to completely eliminate appearance of the display items 12.

If the surface of the cabinet 20 of the video camera, which is one of electronic apparatus, is colored to be metallic or similar thereto such as silvery or golden, the video camera can bring about a high-grade impression. However, since the ground color of the display device 10 is black, when the front panel 21 of the cabinet 20 around the display plane 11 is in any metallic or similar color such as silvery or golden, users may feel some sense of incongruity with regard to such color difference, and consequently there arises a problem that the video camera as a whole presents an odd appearance and fails to bring about a desired high-grade impression.

SUMMARY OF THE INVENTION

It is an object of the present invention to provide a display device adapted for use in an electronic apparatus or the like wherein characters and so forth to be displayed are completely invisible when illuminating light is rendered extinct, and still the appearance thereof is congruous with any metallic or similar color of a cabinet around a display plane.

According to one aspect of the present invention, there is provided an illuminative display device for use in an electronic apparatus where the periphery thereof has a metallic-color surface. The display device comprises a light source and a transparent sheet spaced apart therefrom by a predetermined distance, wherein a colored layer composed of a thin film and being the same or substantially the same in color as the metallic-color surface of the electronic apparatus is formed on one side of the transparent sheet opposed to the light source, and a backing layer with cutout characters is formed on one side of the colored layer opposed to the light source.

Therefore, when a light emitting diode is turned off in the display device of the present invention, there occurs diffused reflection of light on the colored layer to consequently render the cutout characters completely invisible, and still a metallic impression is attainable in a manner to be congruous with the metallic color of the peripheral cabinet.

DESCRIPTION OF THE PREFERRED EMBODIMENTS

Hereinafter some preferred embodiments of the display device of the present invention will be described with reference to FIGS. 1 to 3.

Figure 1:
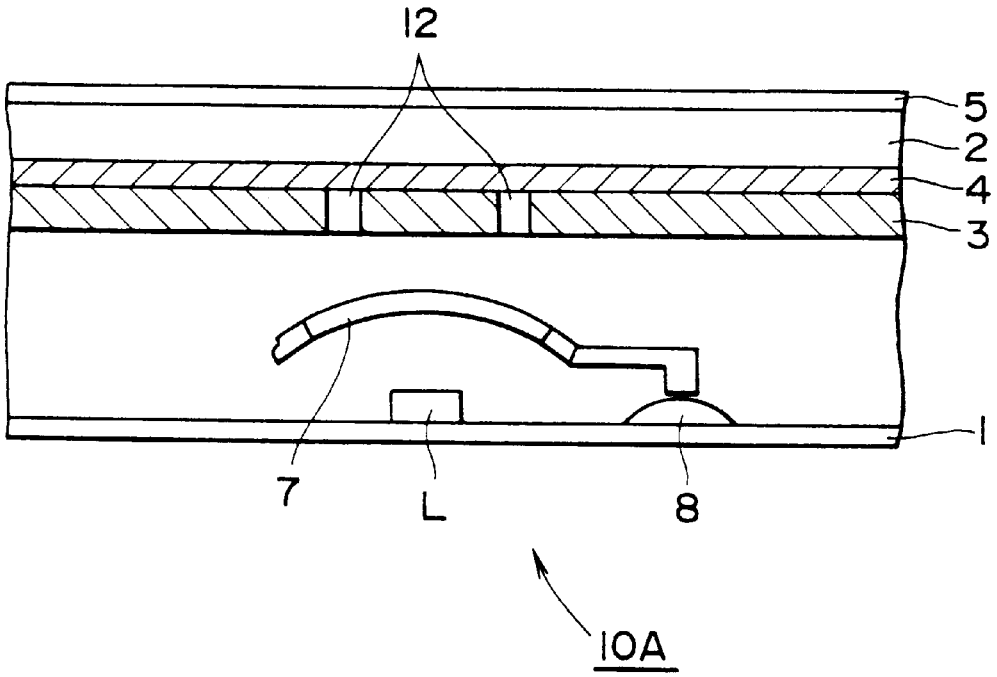
FIG. 1 is a partly sectional view of an illuminative display device employed in an electronic apparatus embodying the present invention.
Figure 2A:
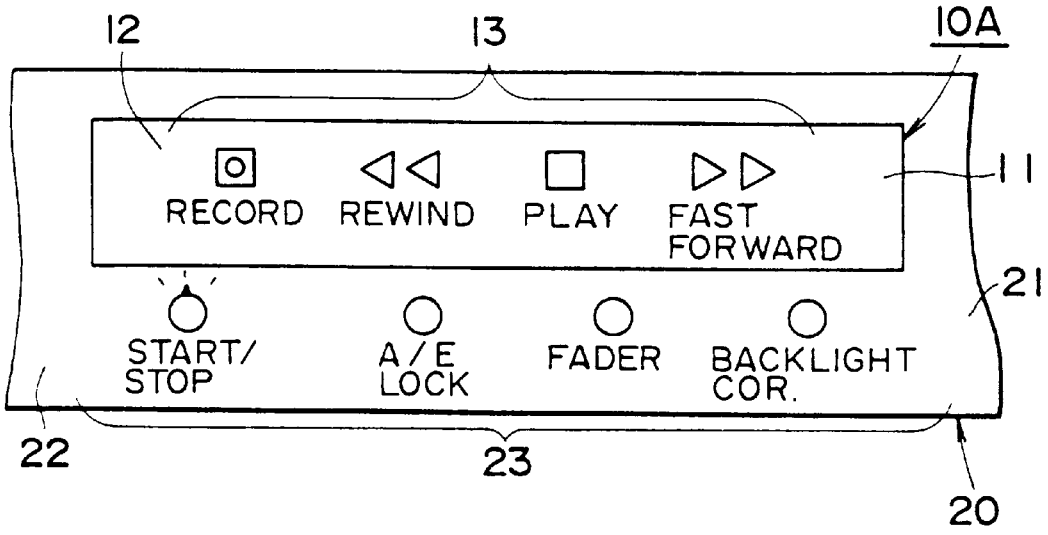
FIG. 2A is a plan view of a first embodiment of the illuminative display device incorporated in a cabinet of the electronic apparatus of FIG. 1 and placed in its one display state.
Figure 2B:
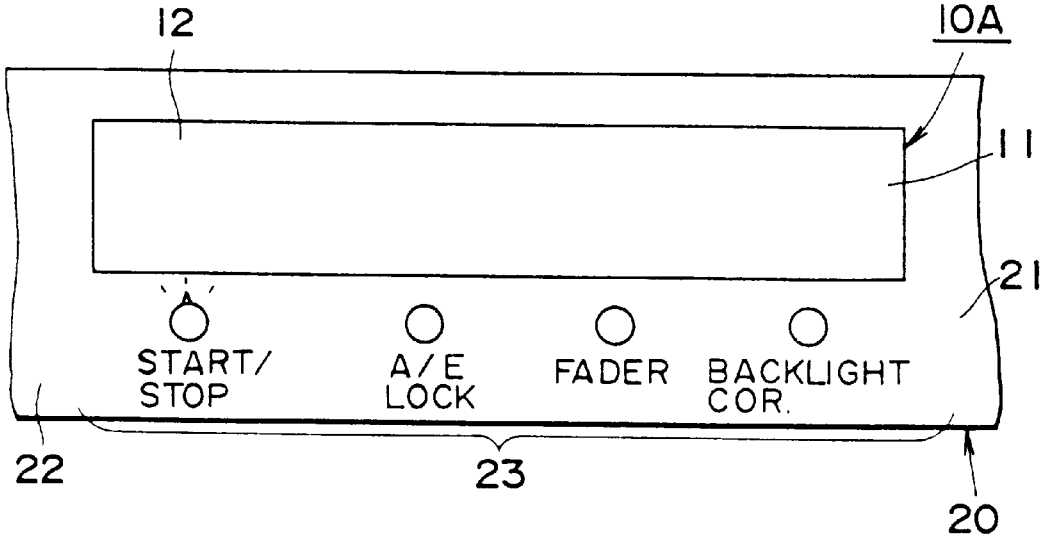
FIG. 2B is a plan view of the first embodiment placed in its another display state where the display items thereof are partially turned off.
Figure 3A:
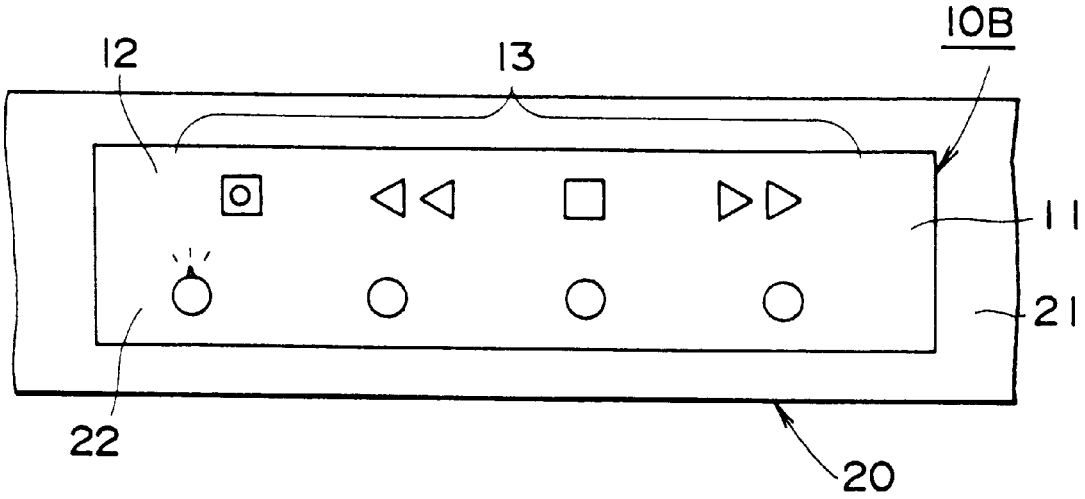
FIG. 3A is a plan view of a second embodiment of the illuminative display device incorporated in a cabinet of an electronic apparatus of the invention and placed in its one display state.
Figure 3B:
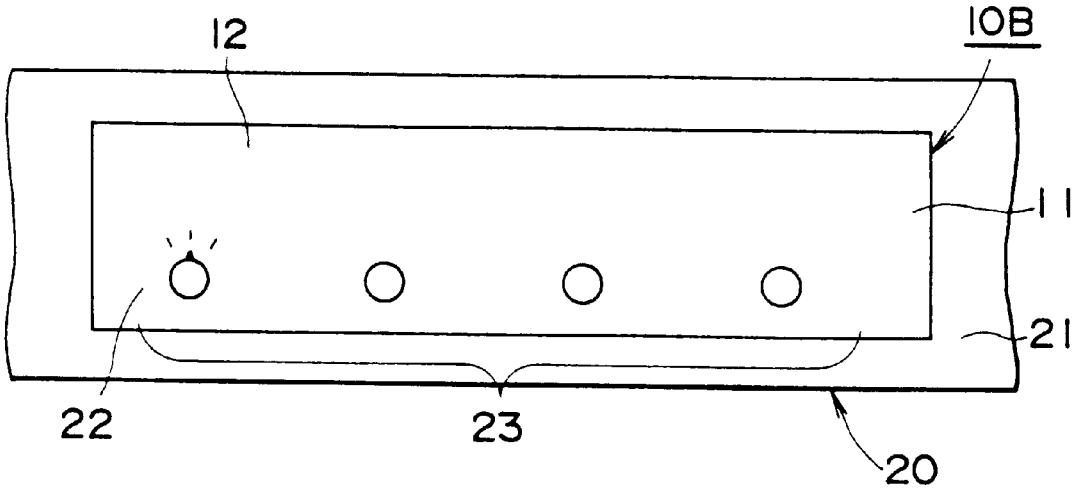
FIG. 3B is a plan view of the second embodiment placed in its another display state where the display items thereof are partially turned off.

FIG. 1 is a partly sectional view of an illuminative display device employed in an electronic apparatus embodying the present invention. FIG. 2A is a plan view of a first embodiment of the illuminative display device incorporated in a cabinet of the electronic apparatus of FIG. 1 and placed in its one display state, and FIG. 2B is a plan view of the first embodiment placed in its another display state where the display items thereof are partially turned off. FIG. 3A is a plan view of a second embodiment of the illuminative display device incorporated in a cabinet of an electronic apparatus of the invention and placed in its one display state, and FIG. 3B is a plan view of the second embodiment placed in its another display state where the display items thereof are partially turned off.

In the drawings, any components corresponding to those in the aforementioned display device 10 of the related art are denoted by like reference numerals.

First a description will be given on the structure of the display device according to the present invention.

Figure 7:
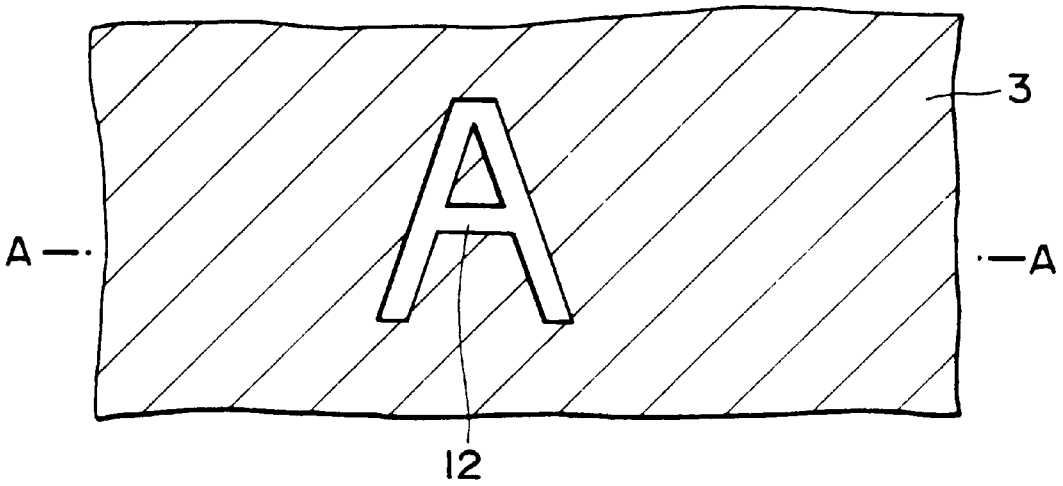
FIG. 7 PRIOR ART
FIG. 7 is a plan view illustrating the inner surface of a transparent sheet used in the illuminative display device of FIG. 6.

In FIGS. 1 and 2, reference numeral 10A denotes the display device of the present invention. This display device 10A also comprises a light emitting diode L mounted on a printed-circuit board 1 and a transparent sheet 2 spaced apart therefrom by a predetermined distance. On one side (inner surface) of the transparent sheet 2 opposed to the light emitting diode L, there is formed a silvery thin-film colored layer 4 of aluminum for example by a thin film forming technique such as evaporation or sputtering. The colored layer 4 has an adequate thickness of 0.01 to 0.05 $\mu$m. Further on the surface of the colored layer 4, there is printed a black-base character-cutout backing layer 3, such as one shown in FIG. 7, with display items 12 representing the names of operation keys 13 and so forth for the a aforementioned subsidiary recording/playback function.

The base color of the character-cutout backing layer 3 is not limited to black alone.

Figure 4A:
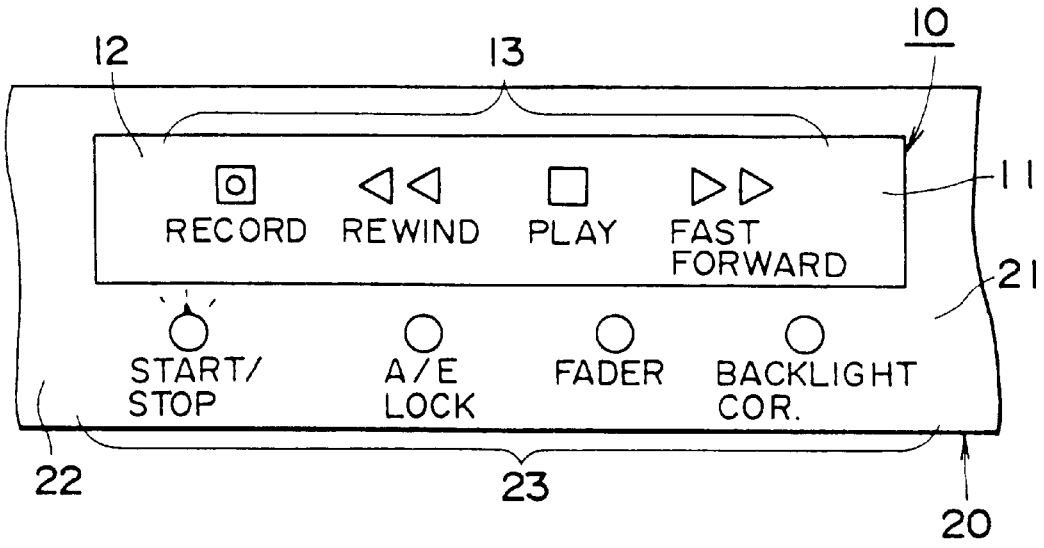
FIG. 4A PRIOR ART
FIG. 4A is a plan view of a known illuminative display device of the related art incorporated in a cabinet of a ordinary electronic apparatus and placed in its one display state.
Figure 4B:
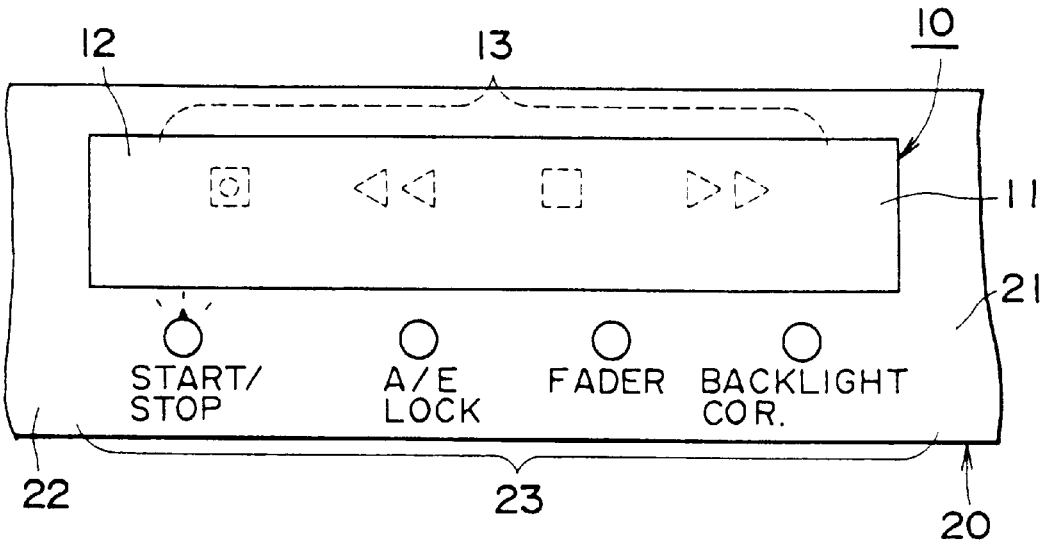
FIG. 4B PRIOR ART
FIG. 4B is a plan view of the above display device placed in its another display state where the display items thereof are partially turned off.

FIGS. 2A and 2B show a display plane 11 of the display device 10A of such a structure viewed from the surface of the transparent sheet 2. And on a front panel 21 of a peripheral cabinet 20 around the display plane 11, display items 22 representing operation keys 23 for the camera shooting function are printed in parallel with the display items 12. FIGS. 2A and 2B correspond to FIGS. 4A and 4B, respectively.

Figure 5A:
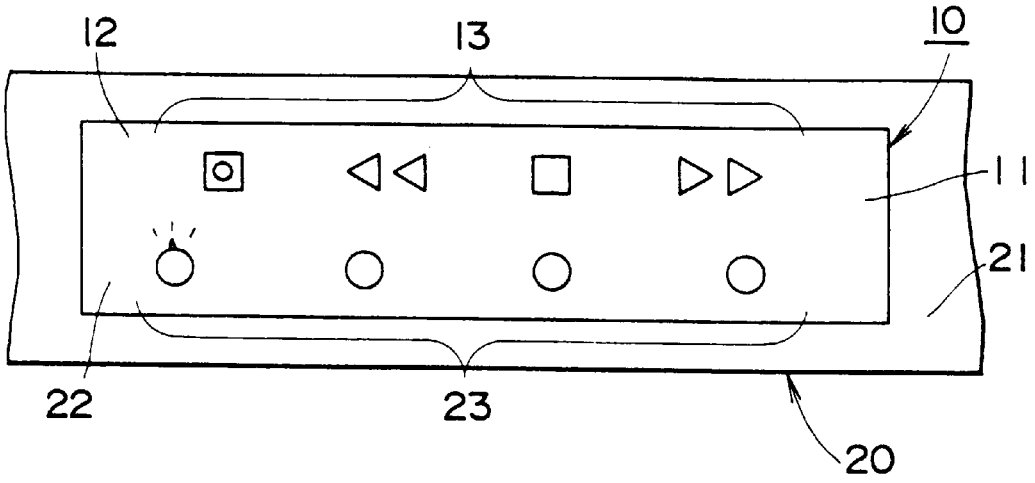
FIG. 5A PRIOR ART
FIG. 5A is a plan view of another known illuminative display device of the related art incorporated in a cabinet of a ordinary electronic apparatus and placed in its one display state.
Figure 5B:
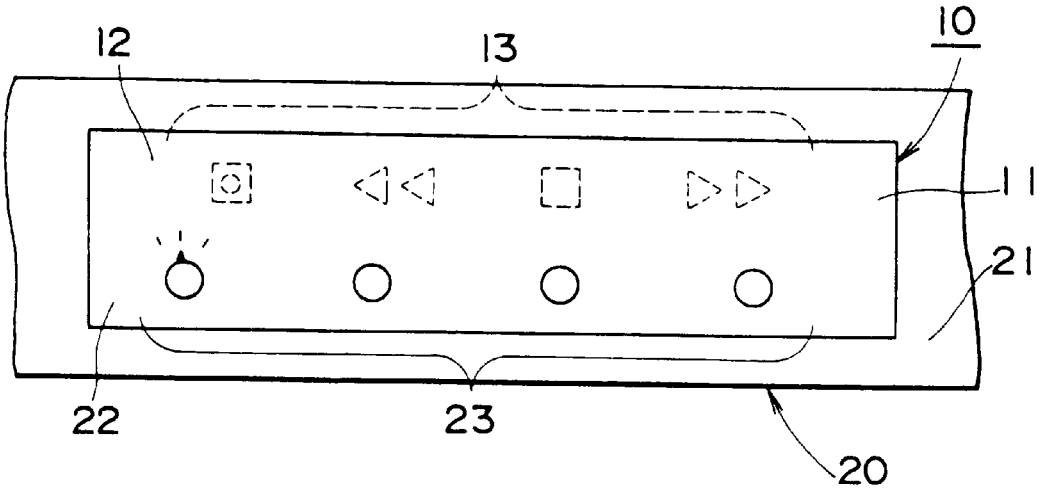
FIG. 5B PRIOR ART
FIG. 5B is a plan view of the above display device placed in its another display state where the display items thereof are partially turned off.
Figure 6:
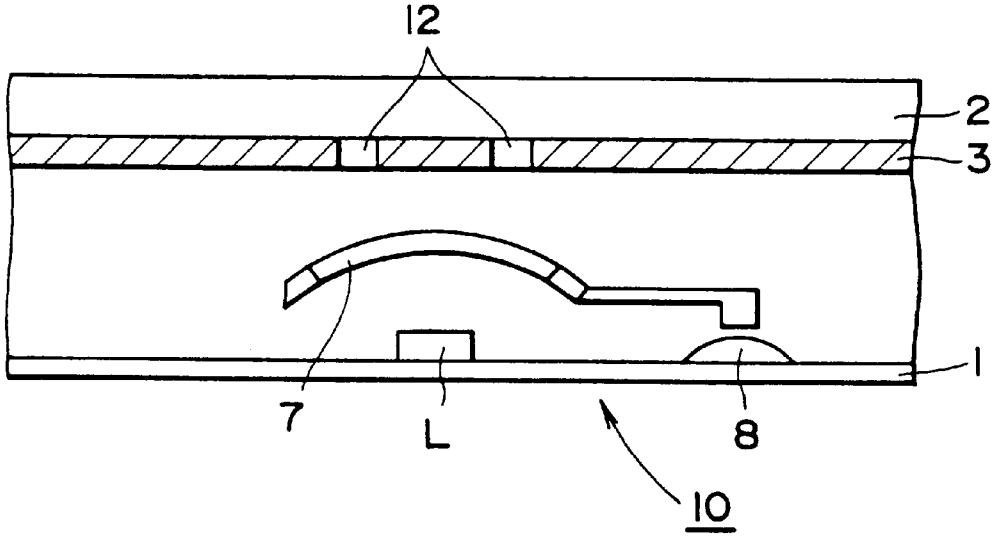
FIG. 6 PRIOR ART
FIG. 6 is a partly sectional view of a known illuminative display device of the related art incorporated in a ordinary electronic apparatus.

In the aforementioned display method of FIG. 5, display items 22 representing operation keys 23 and so forth for the main camera shooting function are printed on the surface of the transparent sheet 2 (reverse side with respect to the light emitting diode L) at positions not overlapping with the display items 12 relative to the recording/playback function, as in the display device 10B of FIG. 3.

In the present invention also, similarly to the known device of the related art, the transparent sheet 2 may be composed of, for example, transparent polyethylene resin, polycarbonate resin, acrylic resin or vinyl chloride resin.

Therefore, each of the display devices 10A and 10B having the above-described structure is advantageous in the point that, when the light emitting diode L is turned off, i.e., when the video camera is driven in the camera shooting mode, the display items 12 of cutout characters are rendered completely invisible by the mirror effect of the aluminum-evaporated thin film surface of the colored layer 4, as illustrated in FIGS. 2B and 3B. Moreover, the display plane 11 seems to be substantially the same in color as the front panel 21 of the cabinet 20, e.g., a silvery metallic color, so that it becomes possible to eliminate the incongruous impression existent in the known display device 10 of the related art. And still a metallic impression is attainable as well to consequently achieve a high-grade external view in the video camera equipped with such display device 10A or 10B.

Meanwhile when the light emitting diode L is turned on, i.e., wren the video camera is driven in the recording/playback mode, the characters of operation keys 13 and so forth are caused to appear as display items 12, which are thereby recognized by the user.

In the present invention, an urethane resin layer 5 is further formed on the surface of the transparent sheet 2 for the purpose of giving a high-grade impression. In case this urethane resin layer 5 is not existent, hair lines derived from aluminum evaporation of the colored layer 4 are seen on the surface of the transparent sheet 2 and may give an undesired impression that a cheap tin plate or the like is attached thereto. For this reason, the existence of the urethane resin layer 5 is effective to avoid such an impression.

In addition, a soft touch is ensured in depressing the display plane 11 to consequently bring about an enhanced high-grade feeling.

Although the present invention has been described hereinabove with reference to some preferred embodiments thereof, it is to be understood that the invention is not limited to such embodiments alone, and a variety of other changes and modifications will be apparent to those skilled in the art without departing from the spirit of the invention.

The scope of the invention, therefore, is to be determined solely by the appended claims.

What is claimed is:

1. An electronic apparatus having a metallic-color peripheral surface, comprising:

an illuminative display device including:

a light source; and a transparent sheet spaced apart therefrom by a predetermined distance;

wherein a colored layer formed of an aluminum-evaporated thin film surface and being the same or substantially the same in color as said metallic color is formed on the same side of said transparent sheet as said light source and has printed information functions thereon, and a black-based backing layer with cutout characters is formed on the opposite side of said colored layer which does not have information functions printed thereon.

2. The electronic apparatus according to claim 1, wherein the thickness of said thin-film colored layer ranges from 0.01 to 0.05 $\mu$m.

3. The electronic apparatus according to claim 1, wherein an urethane resin layer is formed on the surface of said transparent sheet.

4. An electronic apparatus including a cabinet with a metallic-color surface and having at least a main function and a subsidiary function, said apparatus being equipped with an illuminative display device which is disposed in or adjacent to the metallic-color surface of said cabinet and serves for selectively displaying said main and subsidiary functions;

wherein said illuminative display device comprises a light source and a transparent sheet spaced apart therefrom by a predetermined distance; a colored layer formed of an aluminum-evaporated thin film surface and being the same or substantially the same in color as said metallic color is formed on the same side of said transparent sheet as said light source and has printed information thereon, and a black-based backing layer with cutout characters is formed on the opposite side of said colored layer without information functions printed thereon, so as to display the characters relative to the subsidiary function; and other display characters relative to the main function are shown on the surface of said transparent sheet at positions not overlapping with the display characters relative to the subsidiary function.

5. The electronic apparatus according to claim 4, wherein the thickness of said thin-film colored layer ranges from 0.01 to 0.05 $\mu$m.

6. The electronic apparatus according to claim 4, wherein an urethane resin layer is formed on the surface of said transparent sheet.

* * * * *